US006248209B1

(12) United States Patent
Maeda et al.

(10) Patent No.: US 6,248,209 B1
(45) **Date of Patent: *Jun. 19, 2001**

(54) PROCESS FOR BLEACHING CELLULOSE PULP WITH A BLEACHING ASSISTANT HAVING THE FORMULA $R^1$-O-{[($C_2H_4O$)M/(AO)N}]-H

(75) Inventors: Hiroaki Maeda; Daisuke Nakamura; Nobuo Hisada, all of Kyoto (JP)

(73) Assignee: Sanyo Chemical Industries, Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/945,313

(22) PCT Filed: Aug. 6, 1996

(86) PCT No.: PCT/JP96/02204

§ 371 Date: Oct. 28, 1997

§ 102(e) Date: Oct. 28, 1997

(87) PCT Pub. No.: WO97/06304

PCT Pub. Date: Feb. 20, 1997

(30) Foreign Application Priority Data

| | | |
|---|---|---|
| Aug. 10, 1995 | (JP) | 7-227519 |
| Nov. 13, 1995 | (JP) | 7-319512 |
| Jul. 8, 1996 | (JP) | 8-198289 |

(51) Int. Cl.[7] ..... D21C 9/10; D21C 9/12; D21C 9/14; D21C 9/147

(52) U.S. Cl. ..... 162/65; 162/72; 162/78; 162/88

(58) Field of Search ..... 162/65, 78, 72, 162/88, 89, 67, 66, 76

(56) References Cited

U.S. PATENT DOCUMENTS 5,211,811 * 5/1993 Griggs et al. ..... 162/65

FOREIGN PATENT DOCUMENTS

| | | |
|---|---|---|
| 5-186987 | 7/1927 | (JP) . |
| 52-114708 | 2/1977 | (JP) . |
| 4-65593 | 3/1992 | (JP) . |
| 4-289288 | 10/1992 | (JP) . |
| 5-279979 | 10/1993 | (JP) . |

OTHER PUBLICATIONS

Ichiro Nishi and two others, "Handbook of Surfactants", Jul. 5, 1990, Sangyo Toshio Corp. pp. 167–176.

* cited by examiner

*Primary Examiner*—Steve Alvo
(74) *Attorney, Agent, or Firm*—Arent Fox Kintner Plotkin & Kahn, PLLC

(57) ABSTRACT

An aqueous alkaline slurry of cellulose pulp is bleached with oxygen or peroxide by using a compound represented by general formula (1), (2) or (3) as a bleaching assistant:

$$R^1\text{—O—}[(C_2H_4O)_m/(AO)_n]\text{—H} \quad (1)$$

$$R^2\text{—O—}[(C_2H_4O)_m/(AO)_p]\text{—}(AO)_q\text{—H} \quad (2)$$

$$(R^3)_t\text{—X—}[(C_2H_4O)_m/(AO)_p]\text{—}(AO)_r\text{—H} \quad (3)$$

where $R^1$ stands for a branched alkyl group having 6 to 12 carbon atoms, m stands for an average added mol number of 4 to 15, A stands for a propylene, butylene or phenylethylene group, n stands for an average added mol number of 0 to 4, the addition shown in [ ] is in a random or block form, $R^2$ stands for a linear or branched alkyl group having 6 to 12 carbon atoms, p stands for an average added mol number of 0 to 3.9, q stands for an average added mol number of 0.1 to 4, $R^3$ stands for a hydrogen atom, a methyl or ethyl group, or a branched alkyl group having 3 to 12 carbon atoms, t stands for an integer of 1 to 5, X stands for a residual phenol group, and r stands for an average added mol number of from 0 to 4.

8 Claims, No Drawings

PROCESS FOR BLEACHING CELLULOSE PULP WITH A BLEACHING ASSISTANT HAVING THE FORMULA $R^1$-O-{[($C_2H_4O$)M/(AO)N}]-H

TECHNICAL FIELD

This invention relates to a method of bleaching cellulose pulp, and more particularly, to a method of bleaching an alkaline aqueous slurry of cellulose pulp with oxygen, or peroxide.

BACKGROUND ART

Cellulose pulp, which is used for many purposes, usually requires bleaching for the removal of any colored substance therefrom, except when used for purposes not calling for its whiteness, as when it is used for a packing material, such as the core of corrugated cardboard.

It has hitherto been usual to use chlorine-containing bleaching agents, such as chlorine, sodium hypochlorite, sodium chlorite, and a bleaching powder, for bleaching such pulp, simply because they are inexpensive and high in reactivity.

These chlorine-containing bleaching agents exhibit an excellent bleaching action, but their reaction with lignin produces harmful substances including organic chlorine compounds, such as dioxin, as by-products, and thereby presents the problem of environmental pollution. Under these circumstances, it has been a matter of great importance for mankind to have the pulp manufacturing industry decrease, or eventually end the use of chlorine.

It has been becoming common practice on a worldwide basis to employ oxygen gas, or hydrogen peroxide as a bleaching agent in a part of a process for bleaching pulp in order to decrease the use of chlorine. It has, however, been impossible to realize a satisfactory reduction in the use of chlorine, since it has generally been impossible to bleach pulp satisfactorily with oxygen, etc. Attempts have been made to employ high-pressure oxygen gas at a high temperature to obtain an improved bleach of pulp by bleaching with oxygen, while decreasing the use of chlorine even by a small amount, but have presented a new problem, since the depolymerization of cellulose is promoted, and results in pulp of lower strength.

In order to solve the above problem, the applicant of this application has previously proposed a method of realizing an improved bleach of pulp by adding a bleaching assistant during its bleaching with oxygen, hydrogen peroxide, etc. (Japanese Patent Application Laid-Open No. Hei 5-186987).

The above method has been able to realize an improved bleach of pulp as compared with any prior method of bleaching with oxygen, etc., but has still been unsatisfactory, and unable to realize a satisfactory reduction in the use of chlorine. Moreover, the heavy foaming of a bleached pulp slurry has presented a problem of operation during the step of dewatering, etc.

We, the inventors of this invention, have made a serious study of a problem as to how it will be possible to achieve an improved bleach of cellulose pulp and thereby a greater reduction in the use of any chlorine-containing bleaching agent by employing oxygen or peroxide, while having cellulose retain its strength, and without having any problem of operation caused by the foaming of a bleached pulp slurry, and as a result, we have made this invention by finding that the use of a specific compound as a bleaching assistant provides a very effective and economical solution to the above problems.

DISCLOSURE OF THE INVENTION

This invention relates to a method of bleaching cellulose pulp, and employs one or more compounds selected from a compound (U) represented by general formula (1), a compound (V) represented by general formula (2) and a compound (W) represented by general formula (3) as a bleaching assistant when bleaching an alkaline aqueous slurry of cellulose-pulp (pulp slurry) with oxygen or peroxide:

$$R^1—O—[(C_2H_4O)_m/(AO)_n]—H \quad (1)$$

$$R^2—O—[(C_2H_4O)_m/(AO)_p]—(AO)_q—H \quad (2)$$

$$(R^3)_t—X—[(C_2H_4O)_m/(AO)_p]—(AO)_r—H \quad (3)$$

where $R^1$ stands for a branched alkyl group having 6 to 12 carbon atoms, m stands for an average added mol number of 4 to 15, A stands for a propylene, butylene or phenylethylene group, n stands for an average added mol number of 0 to 4, the addition shown in [ ] is in a random or block form, $R^2$ stands for a linear or branched alkyl group having 6 to 12 carbon atoms, p stands for an average added mol number of 0 to 3.9, q stands for an average added mol number of 0.1 to 4, $R^3$ stands for a hydrogen atom, a methyl or ethyl group, or a branched alkyl group having 3 to 12 carbon atoms, t stands for an integer of 1 to 5, X stands for a residual phenol group, and r stands for an average added mol number of from 0, exclusive, to 4, inclusive.

It is possible that $R^1$ in general formula (1), $R^2$ in general formula (2) and $R^3$ in general formula (3) may be a branched alkyl group represented by general formula (4):

$$R^4—\underset{\underset{R^5}{|}}{C}—R^6— \quad (4)$$

where $R^4$ stands for a methyl, ethyl, propyl or butyl group, $R^5$ stands for a linear or branched alkylene group having 1 to 9 carbon atoms, and $R^6$ stands for an alkylene group having 1 or 2 carbon atoms.

The compounds (U) to (W) preferably have a cloud point of 40° C. to 110° C. in a 2% aqueous solution.

Bleaching is usually performed with a chlorine-containing bleaching agent before bleaching with oxygen or peroxide, or thereafter. Bleaching with a chlorine-containing bleaching agent is preferably performed after bleaching with oxygen or peroxide.

The use of the bleaching assistant according to this invention makes it possible to realize an improved bleach of pulp and thereby a reduction in the use of a chlorine-containing bleaching agent, while having cellulose retain its strength. The use of the compound (V) as the bleaching assistant is particularly effective for restraining the foaming of a bleached pulp slurry and eliminating any problem of operation caused by its foaming.

BEST MODE OF CARRYING OUT THE INVENTION

[Compound (U)]

The compound (U) according to this invention is obtained by adding ethylene or propylene oxide, etc. to branched alcohol, and represented by general formula (1):

$$R^1—O—[(C_2H_4O)_m/(AO)_n]—H \quad (1)$$

where $R^1$ stands for a branched alkyl group having 6 to 12 carbon atoms, A stands for a propylene, butylene or phenylethylene group, m stands for an average added mol number of 4 to 15, n stands for an average added mol number of 0 to 4, and the addition shown in [ ] is in a random or block form.

If the branched alkyl group $R^1$ has less than 6, or more than 12 carbon atoms, no satisfactorily improved bleach of pulp can be obtained. The branched alkyl group $R^1$ is preferably represented by general formula (4):

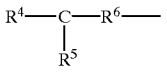

(4)

where $R^4$ stands for a methyl, ethyl, propyl or butyl group, $R^5$ stands for a linear or branched alkylene group having 1 to 9 carbon atoms, and $R^6$ stands for an alkylene group having 1 or 2 carbon atoms.

Specific examples of the branched alkyl group $R^1$ represented by general formula (4) are isohexyl, isoheptyl, isooctyl, 2-ethylhexyl, an isobutylene dimer, isononyl, a propylene trimer, isodecyl, isoundecyl, isododecyl, a propylene tetramer, and a branched alkyl group synthesized by the oxo process. A 2-ethylhexyl or isodecyl group is, among others, preferred.

Referring to $(C_2H_4O)_m$ in general formula (1), $C_2H_4O$ stands for ethylene oxide, and if its average added mol number m is less than 4, or more than 15, no satisfactorily improved bleach of pulp can be obtained. "$C_2H_4O$" is sometimes expressed as "$CH_2CH_2O$".

Referring to $(AO)_n$ in general formula (1), AO stands for one or more of propylene, butylene and styrene oxides, n stands for the total of the average added mol numbers of those oxides, and if its average added mol number n is larger than 4, no satisfactorily improved bleach of pulp can be obtained.

Referring to $(C_2H_4O)_m$ and $(AO)_n$ in general formula (1), there is no rule concerning the order in which $C_2H_4O$ and AO are added. The compound (U), however, excludes any compound having propylene, butylene or styrene oxide added in a block form to the end.

Specific examples of the compound (U) include the following:

EXAMPLE 1

Isodecyl-O—$(EO)_{10}$—H

EXAMPLE 2

2-Ethylhexyl-O—$(EO)_{12}$—H

EXAMPLE 3

2,4-Dimethylheptyl-O—[$(EO)_9$//$(PO)_2$]—H

EXAMPLE 4

Isononyl-O—[$(EO)_{10}$//$(PO)_1$//$(BO)_{0.5}$]—H

EXAMPLE 5

Isodecyl-O—$(EO)_4$-$(BO)_1$—$(SO)_1$—$(EO)_5$—H

EXAMPLE 6

2-Ethylhexyl-O—$(PO)_1$—$(EO)_8$—H

In the above formulas (and also in the formulas which will appear below), EO stands for ethylene oxide, PO stands for propylene oxide, BO stands for butylene oxide, SO stands for styrene oxide, the number written at the right of each ( ) stands for the average added mol number, // stands for addition in a random form, and - stands for addition in a block form.

A 2% aqueous solution of any compound (U) preferably has a cloud point of 40–110° C., and more preferably, 60–100° C.

[Compound (V)]

The compound (V) according to this invention is a modified form of the compound (U), and more particularly, it is obtained by modifying the group selected as $R^1$ in the compound (U), and adding propylene oxide, etc. in a block form to the end, and is represented by general formula (2):

$$R^2—O—[(C_2H_4O)_m/(AO)_p]—(AO)_q—H \quad (2)$$

where $R^2$ stands for a linear or branched alkyl group having 6 to 12 carbon atoms, A stands for a propylene, butylene or phenylethylene group, m stands for an average added mol number of 4 to 15, p stands for an average added mol number of 0 to 3.9, q stands for an average added mol number of 0.1 to 4, and the addition shown in [ ] is in a random or block form.

If the alkyl group $R^2$ has less than 6, or more than 12 carbon atoms, no satisfactorily improved bleach of pulp can be obtained. Examples of the linear alkyl group $R^2$ are n-hexyl, n-heptyl, n-octyl, n-nonyl, n-decyl, n-undecyl and n-dodecyl. Examples of the branched alkyl group $R^2$ are equal to the examples listed before as the branched alkyl group $R^1$ in general formula (1).

$(C_2H_4O)_m$ in general formula (2) stands for the same as it does in general formula (1), and its average added mol number m has its range limited for the same reason.

Referring to $(C_2H_4O)_m$ and $(AO)_p$ in general formula (2), there is no rule concerning the order in which $C_2H_4O$ and AO are added.

Referring to $(AO)_p$ and $(AO)_q$ in general formula (2), AO stands for one or more of propylene, butylene and styrene oxides, as it does in general formula (1). Thus, its average added mol number p (and also q) means the total of the average added mol numbers of the oxides.

If $(AO)_q$ in general formula (2) has an average added mol number q which is smaller than 0.1, the compound is less effective in restraining the bubbling of a bleached pulp slurry than when it has an average added mol number q of 0.1 to 4.

The sum of the average added mol numbers p and q [or the total of the average added mol numbers of propylene, butylene or styrene oxide in general formula (2)] is from 0.1 to 4, and if the sum is larger than 4, no satisfactorily improved bleach of pulp can be obtained.

Specific examples of the compound (V) include the following:

EXAMPLE 1

Isooctyl-O—$(EO)_8(PO)_{0.5}$—H

EXAMPLE 2

Tetrapropylene-O—$(EO)_{11}$—$(SO)_{1.5}$—H

EXAMPLE 3 n-octyl-O—$(EO)_{10}$—$(PO)_1$—H

EXAMPLE 4

Isooctyl-O—$(EO)_{12}$—$(PO)_{0.5}$—$(BO)_{1.5}$—H

EXAMPLE 5

Isononyl-O—[$(EO)_5$//$(PO)_{0.3}$//$(SO)_1$]—$(PO)_{0.2}$—$(BO)_{0.2}$—H

EXAMPLE 6

2,4-Dimethylheptyl-O—[$(EO)_6$//$(BO)_{0.5}$]—$(PO)_1$—H

EXAMPLE 7

2—Ethylhexyl-O—$(EO)_4$—$(PO)_{1.5}$—$(EO)_{5.5}$—$(BO)_{0.5}$—H

EXAMPLE 8

Isodecyl-O—$(BO)_1$-$(EO)_{12}$—$(BO)_1$—H

EXAMPLE 9 n-decyl-O—$(PO)_{0.5}$—$(EO)_{10}$—$(PO)_{0.5}$—$(SO)_{0.5}$—H

A 2% aqueous solution of compound (V) preferably has a cloud point of 40–110° C., and more preferably, 60–100 ° C., as is the case with compound (U).

[Compound (W)]

The compound (W) according to this invention is a modified form of compound (V), and more particularly, it is obtained by modifying the group selected as $R^2$ in compound (V), and substituting a residual phenol group for its —O— component, and is represented by general formula (3):

$$(R^3)_t—X—[(C_2H_4O)_m/(AO)_p]—(AO)_r—H \quad (3)$$

where $R^3$ stands for a hydrogen atom, a methyl or ethyl group, or a branched alkyl group having 3 to 12 carbon atoms, t stands for an integer of 1 to 5, m stands for an average added mol number of 4 to 15, A stands for a propylene, butylene or phenylethylene group, p stands for an average added mol number of 0 to 3.9, r stands for an average added mol number of from 0, exclusive, to 4, inclusive, and the addition shown in [ ] is in a random or block form.

If $R^3$ in general formula (3) is a branched alkyl group having less than 3, or more than 12 carbon atoms, no satisfactorily improved bleach of pulp can be obtained. Examples of the branched alkyl group may be equal to those listed before as the branched alkyl group $R^1$ in general formula (1).

$(C_2H_4O)_m$ in general formula (3) stands for the same as it does in general formula (1), and its average added mol number m has its range limited for the same reason.

Referring to $(C_2H_4O)_m$ and $(AO)_p$ in general formula (3), there is no rule concerning the order in which $C_2H_4O$ and AO are added.

Referring to $(AO)_p$ and $(AO)_r$ in general formula (3) AO stands for one or more of propylene, butylene and styrene oxides, as it does in general formula (1). Thus, its average added mol number p (and also r) means the total of the average added mol numbers of the oxides.

Referring to $(AO)_r$ in general formula (3), its average added mol number r is preferably from 0.1 to 4.

The sum of the average added mol numbers p and r [or the total of the average added mol numbers of propylene, butylene or styrene oxide in general formula (3)] is larger than 0, but not larger than 4, and if the sum is larger than 4, no satisfactorily improved bleach of pulp can be obtained.

[Bleaching Method]

The pulp to which the bleaching method of this invention is applicable is, for example, chemical pulp [such as CGP (chemiground pulp), SCP (semichemical pulp), SP (sulfite pulp), KP (kraft pulp) or AP (alkali pulp)], mechanical pulp [such as GP (ground pulp), RMP (refiner mechanical pulp) or TMP (thermomechanical pulp)], or pulp of used paper, and may be wood pulp [such as pulp of wood of a needle-leaf or broadleaf tree, or of a mixture of wood of needle-leaf and broadleaf trees], or non-wood [herbal] pulp. The pulp may be of the unbleached, or somewhat bleached type.

Sodium hydroxide, sodium carbonate, sodium hydrogen carbonate, ammonia, a kraft-process white liquor, an oxidized white liquor, a green liquor, an oxidized green liquor, sodium tetraborate, sodium metaborate, etc. can be used as an alkaline medium for preparing an alkaline aqueous slurry of pulp (pulp slurry) for the purpose of this invention, though sodium hydroxide is usually used. The amount of the alkaline medium to be added based on the oven-dry weight of pulp is preferably from 0.5 to 3% by weight in terms of sodium oxide ($Na_2O$). The pulp content (by oven-dry weight, also in the following description) of the pulp slurry (or suspension) may be either low (below 10% by weight), or medium (10 to 20% by weight), or high (above 20% by weight).

When oxygen is used for the bleaching method of this invention, either oxygen gas, or oxygen-enriched air may be used, but the use of oxygen gas is preferred in view of the volume of a reaction vessel, its reaction efficiency, etc. The oxygen may be of any pressure from high (10 kg/cm$^2$G or above) to low (below 10 kg/cm$^2$G), but is preferably of a relatively low pressure (from 1 to below 10 kg/cm$^2$G) in order to prevent the promoted depolymerization of cellulose from causing a lowering of pulp strength.

Hydrogen peroxide, peroxy acid [e.g. peracetic acid, percarbonic acid, perboric acid (perborate)], chlorine dioxide, ozone, etc. can be used as the peroxide for the bleaching method of this invention.

The compounds (U) to (W) used as the bleaching assistant according to this invention are usually added in the step of bleaching pulp, but are sometimes added during the preceding step of digesting wood chip, or thereafter. One of the compounds (U) to (W), or an adequate mixture of two or all of them is added. The amount of the compounds (U) to (W) to be added depends on the whiteness required of pulp as bleached, etc., but is usually from 0.1 to 2% by weight based on the oven-dry weight of pulp in its slurry. If it is smaller than 0.1% by weight, no satisfactorily improved bleach of pulp can be obtained, but if it exceeds 2% by weight, no further improvement of bleach can be obtained because of an equilibrium. The use of the compounds (U) to (W) is economical, since they are generally recycled with washings after the step of bleaching pulp, and it is only a very small amount that has to be supplied to maintain the proportion as stated above.

The bleaching assistant according to this invention does not preclude the use of e.g. an alkaline earth metal salt such as a magnesium compound, a chelating, or other agent for preventing cellulose from having a lower degree of polymerization, or a stabilizer for peroxide bleaching, such as a condensed phosphate, or silicate.

A reactor of any type, such as vertical or horizontal, can be used as a bleaching apparatus for carrying out the bleaching methods of this invention. The bleaching assistant according to this invention is usually added through the bottom of an upflow type bleaching column, and though it may be added either before pulp is mixed with oxygen gas, or peroxide, or simultaneously therewith, or thereafter, it is preferable from the standpoint of stirring efficiency to add it simultaneously, or before pulp is mixed with oxygen, or the like. A temperature of from room temperature to 200° C. and a time of from 30 seconds to 20 hours are usually employed for the bleaching treatment.

The following are the conditions which are usually employed for (1) oxygen bleaching with oxygen gas, (2) ozone bleaching, and (3) hydrogen peroxide bleaching, when an alkaline aqueous slurry of pulp has a medium pulp content (10 to 20% by weight):

(1) Oxygen Bleaching

Pulp content: 10–14% by weight, oxygen concentration: 10–30 kg/ton of pulp by oven-dry weight, amount of alkaline medium added: 20–30 kg/ton of pulp by oven-dry weight, amount of magnesium sulfate added: 0–2 kg/ton of pulp by oven-dry weight, bleaching temperature: 90–120° C., time: 50–60 min., column top pressure: 3.5–5 kg/cm$^2$G;

(2) Ozone Bleaching

Pulp content: 10–15% by weight, ozone concentration (based on oven-dry weight of pulp): 0.4–2.0% by weight, bleaching temperature: 20–70° C., time: 5–30 min.;

(3) Hydrogen Peroxide Bleaching

Pulp content: 10–20% by weight, hydrogen peroxide concentration (based on oven-dry weight of pulp): 0.2–2% by weight, bleaching temperature: 60–80° C., time: 120–240 min.;

Bleaching with a common chlorine-containing bleaching agent (e.g. chlorine gas, or hypochlorous acid) is usually performed before or after the step of oxygen gas, or peroxide bleaching as described above. Moreover, enzymatic bleaching may sometimes be combined with it.

EXAMPLES

A further description will now be made of this invention by way of examples embodying it specifically and comparative examples, though these examples and comparative examples are not intended for limiting this invention, but intended for illutrating it.

Although kraft pulp made from wood of a broadleaf tree and pulp made from wood of a needle-leaf tree are employed in the examples and comparative examples, this invention is applicable to any other kind of pulp equally effectively.

In the examples and comparative examples, % will be % by weight.

EXAMPLES 1 to 15 and

Comparative Examples 1 to 12

The following were (u1) to (u5) selected as compounds (U) according to this invention, (v1) to (v7) as compounds (V) according to this invention, and (z1) to (z7) as conventional bleaching assistants:

u1: 2-Ethylhexyl-O—$(EO)_7$—H
u2: 2-Ethylhexyl-O—$(EO)_9$—H
u3: 2-Ethylhexyl-O—$(EO)_{11}$—H
u4: Isodecyl-O—$(EO)_{10}$—H
u5: 2-Ethylhexyl-O—$[(EO)_{10}//(PO)_1]$—H
v1: 2-Ethylhexyl-O—$(EO)_9$—$(PO)_{0.2}$—H
v2: 2-Ethylhexyl-O—$(EO)_9$—$(PO)_{0.6}$—H
v3: 2-Ethylhexyl-O—$[(EO)_{10}//(PO)_1]$—$(PO)_{0.5}$—H
v4: Isohexyl-O—$(EO)_8$—$(BO)_1$—H
v5: n-octyl-O—$(EO)_{10}$—$(PO)_1$—H
v6: n-dodecyl-O—$(EO)_{12}$—$(PO)_1$—H
v7: Isodecyl-O—$(EO)_5$—$(PO)_1$—$(EO)_5$—$(PO)_1$—H
z1: Isopropyl-O—$(EO)_5$—H
z2: 2-Ethylhexyl-O—$(EO)_{20}$—H
z3: 2-Ethylhexyl-O—$[(EO)_{10}/(PO)_{3.5}]$—$(PO)_1$—H
z4: 2-Ethylhexyl-O—$(EO)_{10}$—$(PO)_5$—H
z5: Synthetic alcohol residual —O—$(EO)_{12}$—H (The synthetic alcohol has an average of 14.5 carbon atoms, and a branching ratio of 45%.)

z6: t-butyl-O—$(EO)_9$—H
z7: Oleyl-O—$(EO)_9$—H

An aqueous solution of sodium hydroxide (containing 2% of sodium hydroxide in terms of $Na_2O$ based on the oven-dry weight of pulp) and any of the compounds selected as listed above were added to kraft pulp made from wood of a broadleaf tree after its digesting and washing to prepare an alkaline aqueous slurry having a pulp content of 12%, and each such slurry was kneaded in a kneader at room temperature for 10 minutes to prepare each pulp slurry for a bleaching test as shown at Examples 1 to 15 (see Table 1) and Comparative Examples 1 to 12 (see Table 2). The pulp slurries according to Comparative Examples 11 and 12, however, did not contain any bleaching assistant, but were used as standards for comparison. In Tables 1 and 2, the "amount *1" of the bleaching assistant is shown by its weight percentage based on the oven-dry weight of the pulp, and the "cloud point *2" of the bleaching assistant is the cloud point of its 2% aqueous solution.

Then, the pulp slurry according to each Example or Comparative Example was placed in an autoclave, and after it had thoroughly been purged with oxygen gas, the slurry was bleached with oxygen gas for 30 minutes at an oxygen pressure maintained at 5 kg/cm$^2$G and a temperature maintained at 90° C. Immediately after its bleaching, the oxygen pressuer was released, and the pulp slurry was removed from the autoclave, and a liquid was pressed from it at the same temperature. It was thoroughly washed with distilled water, and after filtration, it was dried to yield oxygen-bleached pulp. In Comparative Example 12, however, bleaching was performed by employing an oxygen pressure of 10 kg/cm$^2$G, a temperature of 110° C. and a bleaching time of 120 minutes.

Tests as shown at (1) to (4) below were conducted on the bleached pulp according to each Example or Comparative Example to determine the kappa number and viscosity of the dry oxygen-bleached pulp, the height of a foam formed in the pressed liquid, and a reduction in the amount of chlorine required. The test results are shown in Tables 1 and 2. In Tables 1 and 2, the "difference *3" means the difference in kappa number between the pulp according to each Example or Comparative Example and that according to Comparative Example 11

(1) Method of Determining the Kappa Number of Pulp

It was determined in accordance with JIS-P8211 (Japanese Industrial Standard). A smaller kappa number means a higher degree of bleach.

(2) Method of Determining the Viscosity of Pulp

It was determined in accordance with TAPPI T230-SU-66 (standard of The United States Association of Paper and Pulp Industry) employing cupri-ethylenediamine as a solvent. A higher viscosity of pulp means a greater strength of cellulose.

(3) Method for a Foaming Test

Air was supplied for 10 minutes at a rate of one liter per minute by air stone into 250 ml of a liquid pressed from an oxygen-bleached pulp slurry (having a temperature of 90° C.) and placed in a glass cylinder having an inside diameter of 11 cm, while the liquid temperature was maintained at 90° C., and immediately thereafter, the height (cm) of the foam as formed was measured.

(4) Reduction in the Amount of Chlorine Required

Dry oxygen-bleached pulp was mixed with 1.3% of sodium hydroxide based on its oven-dry weight, and water to prepare an alkaline aqueous slurry having a pulp content of 3%. It was placed in an autoclave, and the air therein was purged with chlorine gas until the amount of chlorine occupied 6% of the oven-dry weight of the pulp. Then, its chlorine bleaching was performed at 50° C. for 60 minutes to make a pulp sheet having a water content of 45% and a Hunter whiteness of 52, and the amount of chlorine as required therefor was determined, and a reduction in the amount of chlorine required was calculated by equation:

$$\text{Reduction of chlorine required}=[(J-K)/J]\times 100$$

J: Amount of chlorine required in Comparative Example 11;

K: Amount of chlorine required in each Example or Comparative Example (except Comparative Example 11).

TABLE 1

Tast results of Examples

| Example | Bleaching assistant Kind | Amount *1 | Cloud point *2 (° C.) | Kappa number | Difference *3 | Pulp viscosity (cP) | Height of foam (cm) | Reduction of chlorine required (%) |
|---|---|---|---|---|---|---|---|---|
| 1 | u1 | 0.8 | 65 | 8.6 | 2.8 | 14.0 | 13.0 | 35 |
| 2 | u2 | 0.8 | 84 | 8.2 | 3.2 | 14.0 | 13.5 | 40 |
| 3 | u3 | 0.8 | 97 | 8.6 | 2.8 | 14.1 | 13.5 | 36 |
| 4 | u4 | 0.8 | 93 | 8.8 | 2.6 | 14.0 | 13.7 | 35 |
| 5 | u5 | 0.8 | 83 | 8.3 | 3.1 | 14.0 | 11.5 | 42 |
| 6 | v1 | 0.8 | 80 | 8.2 | 3.2 | 14.0 | 12.0 | 41 |
| 7 | v2 | 0.05 | 69 | 10.7 | 0.7 | 14.1 | 12.5 | 12 |
| 8 | v2 | 0.2 | 69 | 9.9 | 1.5 | 14.1 | 11.9 | 20 |
| 9 | v2 | 0.8 | 69 | 8.2 | 3.2 | 14.0 | 10.8 | 43 |
| 10 | v2 | 1.8 | 69 | 7.9 | 3.5 | 13.9 | 8.0 | 45 |
| 11 | v3 | 0.8 | 77 | 8.3 | 3.1 | 14.0 | 10.5 | 33 |
| 12 | v4 | 0.8 | 62 | 9.1 | 2.3 | 14.1 | 10.2 | 26 |
| 13 | v5 | 0.8 | 74 | 9.8 | 1.6 | 14.1 | 11.8 | 19 |
| 14 | v6 | 0.8 | 67 | 10.0 | 1.4 | 14.1 | 12.6 | 17 |
| 15 | v7 | 0.8 | 81 | 9.7 | 1.7 | 14.1 | 10.9 | 18 |

TABLE 2

Tast results of Comparative Examples

| Comp. Example | Bleaching assistant Kind | Amount *1 | Cloud point *2 (° C.) | Kappa number | Difference *3 | Pulp viscosity (cP) | Height of foam (cm) | Reduction of chlorine required (%) |
|---|---|---|---|---|---|---|---|---|
| 1 | z1 | 0.8 | 102 | 11.1 | 0.3 | 14.0 | 12.9 | 4 |
| 2 | z2 | 0.8 | 115 or above | 11.0 | 0.4 | 14.1 | 53.7 | 5 |
| 3 | z3 | 0.8 | 35 | 11.0 | 0.3 | 14.1 | 7.0 | 2 |
| 4 | z4 | 0.8 | 28 | 11.3 | 0.1 | 14.0 | 6.2 | 0 |
| 5 | z5 | 0.8 | 81 | 10.9 | 0.5 | 14.0 | 30.0 | 7 |
| 6 | z6 | 0.2 | 115 or above | 11.0 | 0.4 | 14.1 | 12.8 | 5 |
| 7 | z6 | 0.8 | 115 or above | 10.9 | 0.5 | 14.1 | 13.0 | 8 |
| 8 | z7 | 0.05 | 47 | 11.3 | 0.1 | 14.1 | 13.0 | 1 |
| 9 | z7 | 0.2 | 47 | 11.3 | 0.1 | 14.1 | 13.0 | 1 |
| 10 | z7 | 0.8 | 47 | 11.2 | 0.2 | 14.1 | 12.5 | 2 |
| 11 | — | — | — | 11.4 | — | 14.1 | 12.8 | — |
| 12 | — | — | — | 10.4 | 0.2 | 9.5 | 13.2 | 10 |

As shown at Examples 1 to 15 in Table 1, the bleaching pulp with oxygen gas using the bleaching assistants (u1) to (u5) and (v1) to (v7) according to this invention makes it possible to realize an improved bleach of pulp and a reduction in the amount of chlorine required, without causing any lowering of pulp viscosity, as compared with Comparative Examples 1 to 10 in Table 2 where the conventional bleaching assistants (z1) to (z7) are used.

Moreover, the use of the bleaching assistants (u1) to (u5) and (v1) to (v7) according to this invention makes it possible to decrease any foaming of a liquid pressed from a bleached pulp slurry and avoid any problem of operation caused otherwise by its foaming, as compared with the cases where the conventional bleaching assistants (z1) to (z7) are used. The use of, among others, the bleaching assistants (v1) to (v7), or the compounds (V) according to this invention, makes it possible to achieve an outstanding good result in restraining any foaming and thereby reduce the amount of any defoaming agent that is usually employed.

EXAMPLE 16 and

Comparative Example 13

A bleaching test was conducted on digested kraft pulp made from wood of a broadleaf tree (having a kappa number of 18.0) by selecting v8: 2-ethylhexyl-O—$(EO)_9$—$(PO)_{0.6}$—H as compound (V) according to this invention, and using ozone instead of oxygen gas, and otherwise repeating the process as described before. The conditions employed for the bleaching test were a pulp content of 15%, an ozone concentration of 1.8% (based on the oven-dry weight of pulp), an ozone flow rate of 4 liters per minute, an addition of (v8) in the amount of 0.8% (based on the oven-dry weight of pulp), a bleaching temperature of 20° C., a bleaching time of 30 minutes and a pH of 7.

As Comparative Example 13, a similar test was conducted without using any bleaching assistant.

The pulp as bleached in Example 16 of this invention showed a kappa number of 4.0, while the pulp as bleached in Comparative Example 13 not using any bleaching assistant showed a kappa number of 7.5. As regards the viscosity of the pulp as bleached, substantially the same results were obtained in Example 16 and Comparative Example 13. It is, thus, obvious that a greatly improved bleach can be obtained from ozone bleaching, too, if it is performed by using the bleaching assistant according to this invention.

EXAMPLE 17 and

Comparative Example 14

A bleaching test was conducted on digested pulp made from wood of a needle-leaf tree (having a whiteness of 39 and a kappa number of 31) by selecting (v8) as compound (V) according to this invention, and using hydrogen peroxide instead of oxygen gas or ozone, and otherwise repeating the process as described before. The conditions employed for the bleaching test were a pulp content of 10%, a hydrogen peroxide concentration of 0.51% (based on the oven-dry weight of pulp), an addition of (v8) in the amount of 0.8% (based on the oven-dry weight of pulp), a bleaching temperature of 60° C., and a bleaching time of 120 minutes.

As Comparative Example 14, a similar test was conducted without using any bleaching assistant.

The pulp as bleached in Example 17 of this invention showed a whiteness of 79.5, while the pulp as bleached in Comparative Example 14 not using any bleaching assistant showed a whiteness of 72.4. It is, thus, obvious that a greatly improved bleach can be obtained from hydrogen peroxide bleaching, too, if it is performed by using the bleaching assistant according to this invention.

EXAMPLES 18 and 19,

Reference Example 1, and

Comparative Examples 15 to 17

The following are (w1) and (w2) selected as compounds (W) according to this invention, (k1) as Reference Example 1, and (z6) and (z7) as conventional bleaching assistants:

w1: Propylene trimer substituted phenol-$(EO)_{16}$—$(PO)_1$—H w2: Ethylene tetramer substituted phenol-$(EO)_{16}$—$(PO)_2$—H k1: Propylene trimer substituted phenol-$(EO)_{11}$—H z6: t-butyl-O—$(EO)_9$—H z7: Oleyl-O—$(EO)_9$—H Then, Examples 1 to 15 were repeated for preparing pulp slurries for a bleaching test as Examples 18 and 19 and Reference Example 1, conducting a bleaching test with oxygen, and determining the kappa number and viscosity of the dry oxygen-bleached pulp according to each Example or Reference Example, the height of a foam as formed in a liquid pressed from it, and the reduction in the amount of chlorine as required.

Some of the Comparative Examples as described before were adopted as Comparative Examples 15 to 17 without having any bleaching test conducted. More specifically, Comparative Example 7 was adopted as Comparative Example 15, and Comparative Example 10 as Comparative Example 16. Comparative Example 11 not using any bleaching assistant was adopted as Comparative Example 17 to serve as a standard for comparison.

The test results are shown in Table 3. In Table 3, the "amount *1" of the bleaching assistant is shown by its weight percentage based on the oven-dry weight of the pulp, the "cloud point *2" of the bleaching assistant is the cloud point of its 2% aqueous solution, and the "difference *3" means the difference in kappa number between the pulp according to each Example, Reference Example or Comparative Example and that according to Comparative Example 17.

TABLE 3

| | Bleaching assistant | | | Test results | | | | |
|---|---|---|---|---|---|---|---|---|
| | Kind | Amount *1 | Cloud point *2 (° C.) | Kappa number | Difference *3 | Pulp viscosity (cP) | Height of foam (cm) | Reduction of chlorine required (%) |
| Ex. | | | | | | | | |
| 18 | w1 | 0.8 | 93 | 9.6 | 1.8 | 14.1 | 12.4 | 21 |
| 19 | w2 | 0.8 | 92 | 9.5 | 1.9 | 14.1 | 11.9 | 23 |
| Ref. Ex. | | | | | | | | |
| 1 | k1 | 0.8 | 73 | 9.6 | 1.8 | 14.1 | 13.1 | 21 |
| Comp. Ex. | | | | | | | | |
| 15 | z6 | 0.8 | 115 or above | 10.9 | 0.5 | 14.1 | 13.0 | 8 |
| 16 | z7 | 0.8 | 47 | 11.2 | 0.2 | 14.1 | 12.5 | 2 |
| 17 | — | — | — | 11.4 | — | 14.1 | 12.8 | — |

As shown at Examples 18 and 19 in Table 3, the bleaching of pulp with oxygen gas using the bleaching assistants (w1) and (w2) according to this invention makes it possible to realize an improved bleach of pulp and a reduction in the amount of chlorine required, without causing any lowering of pulp viscosity, as compared with Comparative Examples 15 and 16 in Table 3. Moreover, the use of the bleaching assistants (w1) and (w2) according to this invention makes it possible to achieve an outstanding good result in restraining any foaming and thereby reduce the amount of any defoaming agent that is usually employed.

Industrial Utility

The method of bleaching cellulose pulp according to this invention is used in the manufacture of cellulose pulp as a method of bleaching an alkaline aqueous slurry of pulp with oxygen or peroxide, as described above.

What is claimed is:

1. A method of bleaching cellulose pulp, comprising bleaching an alkaline aqueous slurry of cellulose pulp with a bleaching agent in the presence of a bleaching assistant compound, wherein the cellulose pulp is bleached with an amount of a chlorine-containing bleaching agent before or after the cellulose pulp is bleached with the bleaching agent, the bleaching assistant compound being represented by formula (1):

$$R^1—O—\{(C_2H_4O)_m/(AO)_n\}—H \quad (1)$$

wherein $R^1$ is a branched alkyl group having 6 to 12 carbon atoms, m is an average added mol number of 4 to 15, A is a propylene, butylene or phenylethylene group, n is an average added mol number of 0 to 4, and the $(C_2H_4O)_m/(AO)_n$ is in a random or block form, wherein the bleaching assistant compound is present in an amount such that the amount of the chlorine-containing bleaching agent used to bleach the cellulose pulp is reduced as compared to bleaching assistant compounds which do not contain the branched alkyl group having 6 to 12 carbon atoms.

2. The method of bleaching cellulose pulp as set forth in claim 1, wherein in formula (1), the addition shown $(C_2H_4O)_m/(AO)_n$ is in a random form.

3. The method of bleaching cellulose pulp as set forth in claim 1, wherein the compound represented by formula (1) has a cloud point of 40° C. to 110° C. in a 2% aqueous solution containing the compound.

4. The method of bleaching cellulose pulp as set forth in claim 1, wherein the cellulose pulp is unbleached chemical or mechanical pulp.

5. The method of bleaching cellulose pulp as set forth in claim 1, wherein the bleaching agent is oxygen gas.

6. The method of bleaching cellulose pulp as set forth in claim 1, wherein the bleaching agent is selected from the group consisting of hydrogen peroxide, chlorine dioxide, peroxy acids and ozone.

7. The method of bleaching cellulose pulp as set forth in claim 1, wherein the addition shown in { } in formula (1) is in a block form and the compound is other than any compound which has propylene, butylene or styrene oxide added in a block form to the end of the compound.

8. A method of bleaching cellulose pulp, comprising bleaching an alkaline aqueous slurry of cellulose pulp with a bleaching agent in the presence of a bleaching assistant compound, wherein the cellulose pulp is bleached with an amount of a chlorine-containing bleaching agent before or after the cellulose pulp is bleached with the bleaching agent, the bleaching assistant compound being represented by formula (1):

$$R^1—O—\{(C_2H_4O)_m/(AO)_n\}—H$$

wherein $R^1$ is a branched alkyl group having 6 to 12 carbon atoms, m is an average added mol number of 4 to 15, A is a propylene, butylene or phenylethylene group, n is an average added mol number of 0 to 4, and the $(C_2H_4O)_m/(AO)_n$ is in a random or block form, wherein the bleaching assistant compound is present in an amount of 0.1–2.0% by weight based on the oven-dry weight of the pulp in the slurry.

* * * * *